US011439238B1

(12) United States Patent
Wang

(10) Patent No.: US 11,439,238 B1
(45) Date of Patent: Sep. 13, 2022

(54) FOLDING CHAIR

(71) Applicant: Lili Wang, Shenzhen (CN)

(72) Inventor: Lili Wang, Shenzhen (CN)

( * ) Notice: Subject to any disclaimer, the term of this patent is extended or adjusted under 35 U.S.C. 154(b) by 0 days.

(21) Appl. No.: 17/751,010

(22) Filed: May 23, 2022

(30) Foreign Application Priority Data

Apr. 25, 2022 (CN) ..... 202220969915.3

(51) Int. Cl.

| | |
|---|---|
| ***A47C 4/28*** | (2006.01) |
| ***A47C 4/40*** | (2006.01) |
| ***A47C 9/10*** | (2006.01) |
| ***A47C 4/44*** | (2006.01) |
| ***A47C 3/20*** | (2006.01) |

(52) U.S. Cl.
CPC ..... *A47C 4/44* (2013.01); *A47C 3/20* (2013.01); *A47C 4/28* (2013.01); *A47C 4/286* (2013.01); *A47C 9/105* (2013.01)

(58) Field of Classification Search
CPC .... A47C 4/44; A47C 3/20; A47C 4/28; A47C 4/286; A47C 9/105
See application file for complete search history.

(56) References Cited

U.S. PATENT DOCUMENTS

| | | | | |
|---|---|---|---|---|
| 10,010,179 | B1 * | 7/2018 | Stump | A47C 4/44 |
| D933,985 | S * | 10/2021 | Stump | D6/368 |
| 2009/0174233 | A1 * | 7/2009 | Hoffman | A47C 4/286 297/16.2 |
| 2010/0314926 | A1 * | 12/2010 | Chesness | A47C 9/105 297/258.1 |
| 2011/0156449 | A1 * | 6/2011 | Obolewicz | A47C 4/286 297/16.2 |
| 2013/0049410 | A1 * | 2/2013 | Stafford | A47C 7/624 297/16.1 |
| 2014/0306493 | A1 * | 10/2014 | Obolewicz | A47C 4/42 297/16.2 |
| 2015/0091335 | A1 * | 4/2015 | Lee | A47C 4/02 297/16.1 |
| 2015/0091352 | A1 * | 4/2015 | Lee | A47C 4/02 297/344.21 |
| 2015/0189994 | A1 * | 7/2015 | Lee | A47C 4/30 297/16.1 |
| 2017/0181548 | A1 * | 6/2017 | Yoo | A47C 4/30 |
| 2019/0029429 | A1 * | 1/2019 | Browning | A47C 4/02 |
| 2019/0231075 | A1 * | 8/2019 | Browning | A47C 4/286 |
| 2021/0052076 | A1 * | 2/2021 | Graybill | A45C 9/00 |

FOREIGN PATENT DOCUMENTS

WO WO-2021257958 A1 * 12/2021 ..... A47C 3/0255

* cited by examiner

*Primary Examiner* — Robert Canfield

(57) ABSTRACT

A folding chair includes a lower assembly including a lower block and three or more legs pivotally connected to the lower block; an upper assembly including an upper block and three or more arms pivotally connected to the upper block; a middle assembly connecting the upper assembly and the lower assembly; and a flexible seat including the same number of end portions as the number of the arms, wherein each end portion is arranged at an end of each arm away from the upper block, wherein the upper block is provided with a stop portion to limit the rotation angle of the arms, and wherein the arms are retractable, the flexible seat is arranged to be in a relaxed state when the arms are in a retracted state, and in a tight state when the arms are in an extended state.

10 Claims, 4 Drawing Sheets

FOLDING CHAIR

CROSS REFERENCE TO RELATED APPLICATION

This application claims priority benefit of Chinese Utility Model Application No. 202220969915.3, filed on Apr. 25, 2022, and the entire contents of which are incorporated herein by reference.

FIELD OF THE INVENTION

The present disclosure relates to chairs, more specifically, the present disclosure relates to a folding chair.

BACKGROUND OF THE INVENTION

Folding chair is a common chair that offers convenience due to the ability to be collapsed or folded into a compact configuration for portability and storage. However, traditional folding chair has complex structure and is cumbersome to operate, which seriously affects the experience of users.

SUMMARY OF THE INVENTION

Accordingly, the present disclosure is made in an effort to resolve the aforementioned problems. It is an object of the present disclosure to provide a folding chair with simple structure and easy operation.

To achieve the above objects, there is provided a folding chair including a lower assembly including a lower block and three or more legs pivotally connected to the lower block; an upper assembly including an upper block and three or more arms pivotally connected to the upper block; a middle assembly connecting the upper assembly and the lower assembly; and a flexible seat including the same number of end portions as the number of the arms, wherein each end portion is arranged at an end of each arm away from the upper block, wherein the upper block is provided with a stop portion to limit the rotation angle of the arms, and wherein the arms are retractable, the flexible seat is arranged to be in a relaxed state when the arms are in a retracted state, and in a tight state when the arms are in an extended state.

Preferably, the arms include a front arm and a rear arm, and the maximum length of the front arm is less than the maximum length of the rear arm.

Preferably, the stop portion includes a front stop and a rear stop, the angle that the front stop restricts the rotation of the front arm is less than the angle that the rear stop restricts the rotation of the rear arm.

Preferably, the number of the front arm and the rear arm is two respectively.

Preferably, the middle assembly includes a bearing component arranged between the upper block and the lower block, and a central shaft penetrating the upper block, the bearing component and the lower block.

Preferably, the upper block is provided with a downward bulge, and the lower block is provided with an upward bulge, the bearing component includes a connecting portion clamped between the downward bulge and the upward bulge, and an annular portion arranged around the connecting portion, wherein a plurality of steel balls are arranged in the annular portion.

Preferably, the lower assembly further includes a torsion spring arranged inside the leg.

Preferably, the number of legs is four.

Preferably, the lower block is provided with a blocker that limits the rotation angle of the legs.

Preferably, the flexible seat includes a front side in contact with the user when the user sits on the folding chair and a back side opposite to the front side, the back side of the end portion is provided with an arm sleeve, and the end of the arm away from the upper block is accommodated in the arm sleeve.

According to the folding chair of the present disclosure, the folding chair includes a lower assembly including a lower block and three or more legs pivotally connected to the lower block; an upper assembly including an upper block and three or more arms pivotally connected to the upper block; a middle assembly connecting the upper assembly and the lower assembly; and a flexible seat including the same number of end portions as the number of the arms, wherein each end portion is arranged at an end of each arm away from the upper block, wherein the upper block is provided with a stop portion to limit the rotation angle of the arms, and wherein the arms are retractable, the flexible seat is arranged to be in a relaxed state when the arms are in a retracted state, and in a tight state when the arms are in an extended state. When the flexible seat is tightened, the upper assembly will neither overturn forward nor backward, so that the user can sit on it and maintain balance. When retracting the folding chair, shorten the arm first, the seat cloth is than relaxed, the arms can be turned to the direction of the legs to retract the whole folding chair.

BRIEF DESCRIPTION OF THE DRAWINGS

The drawings are provided for further understanding of the invention and constitute a part of the specification. The drawings, together with the embodiments of the invention, are intended to explain the invention, rather than to limit the invention. Drawings.

DETAILED DESCRIPTION OF THE EMBODIMENTS

The solutions in the embodiments of the invention are described clearly and completely below with reference to the drawings in the embodiments of the invention. Apparently, the described embodiments are merely a part, rather than all of the embodiments of the invention. All other embodiments obtained by those of ordinary skill in the art based on the embodiments in the invention without creative efforts should fall within the protection scope of the invention.

As used herein, spatial or directional terms, such as "left", "right", "inner", "outer", "above", "below", "top", "bottom", and the like, are understood to encompass various alternative orientations and, accordingly, such terms are not to be considered as limiting.

Figure 1:
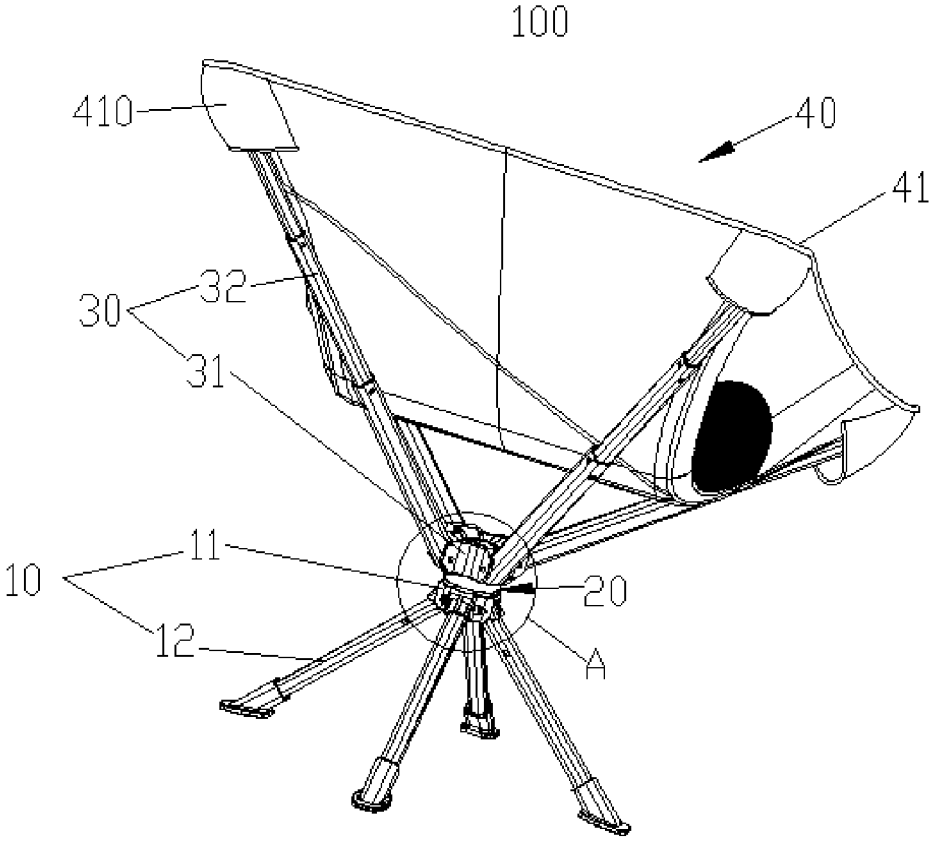
FIG. 1 is a perspective view illustrating a folding chair according to an embodiment of the present disclosure.
Figure 2:
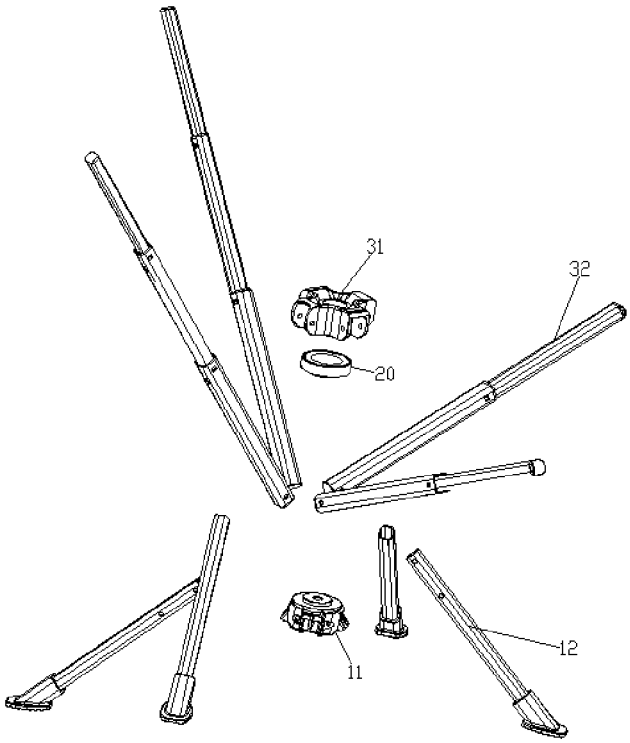
FIG. 2 is an exploded view illustrating a folding chair without a flexible seat according to an embodiment of the present disclosure.
Figure 3:
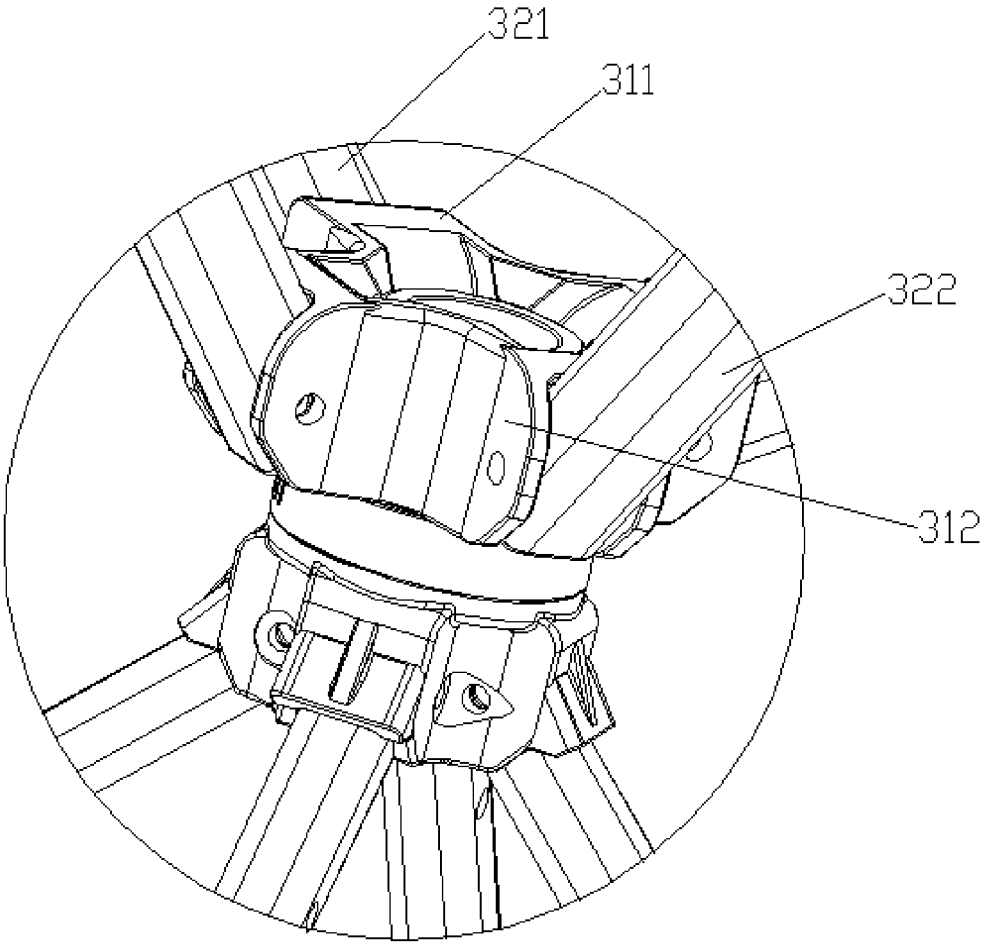
FIG. 3 is an enlarged view illustrating an A portion of FIG. 1.
Figure 4:
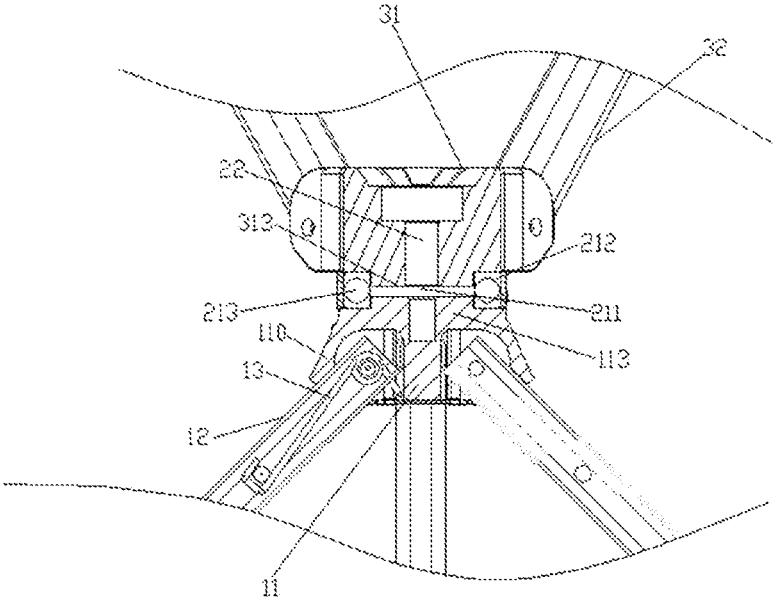
FIG. 4 is a side cross sectional view illustrating the A portion of FIG. 1.

Referring to FIGS. 1 to 4, the present disclosure provides a folding chair 100 including a lower assembly 10, a middle assembly 20, an upper assembly 30 and a flexible seat 40. Wherein the lower assembly 10 includes a lower block 11 and three or more legs 12 pivotally connected to the lower block 11, and the upper assembly 30 includes an upper block 31 and three or more arms 32 pivotally connected to the upper block 31. In this embodiment, the number of arms 32 and legs 12 is four respectively. It is understood that in other embodiments, the number of arms and legs may be the same or different, and the number can be three, five or more, as long as the folding chair can be stably supported on a plane, such as the ground.

The middle assembly 20 is connected to both of the upper assembly 30 and the lower assembly 10, specifically, the middle assembly 20 includes a bearing component 21 arranged between the upper block 31 and the lower block 11, and a central shaft 22 penetrating the upper block 31, the bearing component 21 and the lower block 11.

The flexible seat 40 includes the same number of end portions as the number of the arms 32, in this embodiment, the flexible seat 40 includes four end portions 41, each end portion 41 is arranged at an end of each arm 32 away from the upper block 31. Specifically, the flexible seat 40 includes a front side in contact with the user when the user sits on the folding chair and a back side opposite to the front side, the back side of the end portion 41 is provided with an arm sleeve 410, and the end of the arm 32 away from the upper block 31 is accommodated in the arm sleeve 410. Optionally, the flexible seat 40 is provided with breathable mesh that can improve the user's experience.

The arms 32 are retractable, in this embodiment, the arms 32 include two front arm 321 and two rear arms 322, and the maximum length of the front arm 321 is less than the maximum length of the rear arm 322. The upper block 31 is provided with a stop portion to limit the rotation angle of the arms 32, the stop portion includes two front stop 311 and two rear stop 312, the angle that the front stop 311 restricts the rotation of the front arm 321 is less than the angle that the rear stop 312 restricts the rotation of the rear arm 322.

The flexible seat 40 is arranged to be in a relaxed state when the arms 32 are in a retracted state, and in a tight state when the arms 32 are in an extended state, specifically, the flexible seat 40 is made by splicing cloth, the flexible seat 40 is in a tight state means that the edge of the flexible seat 40 is tight. When the user wants to expand the folding chair 100, he should pull the two rear arms 322 to the maximum length and the two front arms 321 to the maximum length. The flexible seat 40 is tightened, and the four arms 32 are pulled by the four ends 41 of the flexible seat 40 respectively, so they cannot turn down, the arms 32 can maintain a stable upward opening state by cooperating with the tight flexible seat 40. When the user sits on the flexible seat 40, the center of gravity of the upper assembly 30 will shift forward or backward, at this time, the front stop 311 and the rear stop 312 limit the rotation angle of the front arm 321 and the rear arm 322 respectively, which can prevent the upper assembly 30 from turning forward or backward. When the user wants to retract the folding chair 100, first shorten the four arms 32, and then the flexible seat 40 is released, the arms 32 will sag naturally, so the arms 32 can be turned down and retracted together with the legs 12.

Therefore, when the flexible seat is tightened, the upper assembly will not overturn forward or backward, so that the user can sit on it and maintain balance. When retracting the folding chair, shorten the arm first, the seat cloth is than relaxed, the arms can be turned to the direction of the legs to retract the whole folding chair. Such folding chair has simple structure and is convenient to operate. Only by the cooperation of the upper assembly 30 and the flexible seat 40, it can maintain a stable part for the user to sit on.

Preferably, the upper block 31 is provided with a downward bulge 313, and the lower block 11 is provided with an upward bulge 113, the bearing component 21 includes a connecting portion 211 clamped between the downward bulge 313 and the upward bulge 113, and an annular portion 212 arranged around the connecting portion 211. A plurality of steel balls 213 are arranged in the annular portion 212, such that the folding chair 100 has the function of rotating chair.

In this embodiment, the number of legs 12 is four. Preferably, the lower assembly 10 further includes a torsion spring 13 arranged inside the leg 12, and the lower block 11 is provided with a blocker 110 that limits the rotation angle of the legs 12, which allows the user to easily and quickly operate the legs 12 and keep the legs 12 stable when bearing the weight of the user.

According to the folding chair of the present disclosure, the folding chair includes a lower assembly including a lower block and three or more legs pivotally connected to the lower block; an upper assembly including an upper block and three or more arms pivotally connected to the upper block; a middle assembly connecting the upper assembly and the lower assembly; and a flexible seat including the same number of end portions as the number of the arms, wherein each end portion is arranged at an end of each arm away from the upper block, wherein the upper block is provided with a stop portion to limit the rotation angle of the arms, and wherein the arms are retractable, the flexible seat is arranged to be in a relaxed state when the arms are in a retracted state, and in a tight state when the arms are in an extended state. When the flexible seat is tightened, the upper assembly will neither overturn forward nor backward, so that the user can sit on it and maintain balance. When retracting the folding chair, shorten the arm first, the seat cloth is than relaxed, the arms can be turned to the direction of the legs to retract the whole folding chair.

Although the embodiments of the invention are described, it should be understood that those of ordinary skill in the art may make various changes, modifications, replacements, and variations to the above embodiments without departing from the principle and spirit of the invention, and the scope of the invention is subjected to the appended claims and legal equivalents thereof.

What is claimed is:

1. A folding chair, comprising:

a lower assembly comprising a lower block and three or more legs pivotally connected to the lower block;

an upper assembly comprising an upper block and three or more arms pivotally connected to the upper block;

a middle assembly connecting the upper assembly and the lower assembly; and a flexible seat comprising the same number of end portions as the number of the arms, wherein each end portion is arranged at an end of each arm away from the upper block, wherein the upper block is provided with a stop portion to limit the rotation angle of the arms, and wherein the arms are retractable, the flexible seat is arranged to be in a relaxed state when the arms are in a retracted state, and in a tight state when the arms are in an extended state.

2. The folding chair according to claim 1, wherein the arms comprise a front arm and a rear arm, and the maximum length of the front arm is less than the maximum length of the rear arm.

3. The folding chair according to claim 2, wherein the stop portion comprises a front stop and a rear stop, the angle that the front stop restricts the rotation of the front arm is less than the angle that the rear stop restricts the rotation of the rear arm.

4. The folding chair according to claim 2, wherein the number of the front arm and the rear arm is two respectively.

5. The folding chair according to claim 1, wherein the middle assembly comprises a bearing component arranged between the upper block and the lower block, and a central shaft penetrating the upper block, the bearing component and the lower block.

6. The folding chair according to claim 5, wherein the upper block is provided with a downward bulge, and the lower block is provided with an upward bulge, the bearing component comprises a connecting portion clamped between the downward bulge and the upward bulge, and an annular portion arranged around the connecting portion, wherein a plurality of steel balls are arranged in the annular portion.

7. The folding chair according to claim 1, wherein the lower assembly further comprises a torsion spring arranged inside the leg.

8. The folding chair according to claim 7, wherein the number of legs is four.

9. The folding chair according to claim 7, wherein the lower block is provided with a blocker that limits the rotation angle of the legs.

10. The folding chair according to claim 1, wherein the flexible seat comprises a front side in contact with the user when the user sits on the folding chair and a back side opposite to the front side, the back side of the end portion is provided with an arm sleeve, and the end of the arm away from the upper block is accommodated in the arm sleeve.

* * * * *